US011465795B2

(12) United States Patent
Cooper

(10) Patent No.: US 11,465,795 B2
(45) Date of Patent: Oct. 11, 2022

(54) AUTOMATION FOR PLASTIC DISC

(71) Applicant: AVERY DENNISON CORPORATION, Glendale, CA (US)

(72) Inventor: William J. Cooper, Shrewsbury, MA (US)

(73) Assignee: Avery Dennison Corporation, Mentor, OH (US)

( * ) Notice: Subject to any disclaimer, the term of this patent is extended or adjusted under 35 U.S.C. 154(b) by 16 days.

(21) Appl. No.: 15/487,711

(22) Filed: Apr. 14, 2017

(65) Prior Publication Data

US 2018/0297734 A1 Oct. 18, 2018

(51) Int. Cl.
*B65C 7/00* (2006.01)

(52) U.S. Cl.
CPC ..... *B65C 7/003* (2013.01)

(58) Field of Classification Search
CPC ..... G09F 3/12; B65C 7/003–008
USPC ..... 227/15–18, 107, 140
See application file for complete search history.

(56) References Cited

U.S. PATENT DOCUMENTS 1,415,330 A * 5/1922 Frankel ..... A41H 37/005 227/36
1,701,240 A * 2/1929 Maclean ..... B31D 1/025 493/480
2,908,908 A * 10/1959 Steinmetz ..... A41H 37/02 227/135
2,935,434 A * 5/1960 Dawson ..... B29C 65/564 264/248
3,064,264 A * 11/1962 Spinney ..... B68G 7/12 227/18
3,225,993 A * 12/1965 Hall ..... A41H 37/04 227/18
3,402,435 A 9/1968 Merser
3,470,637 A 10/1969 Daddona, Jr.
3,589,584 A * 6/1971 Ohlsson ..... B25C 1/18 227/10
3,589,957 A * 6/1971 Cohn ..... A41H 37/02 156/176
3,650,451 A 3/1972 Weiland et al.
(Continued)

FOREIGN PATENT DOCUMENTS

BE 757335 4/1971
CN 2880736 3/2007
(Continued)

OTHER PUBLICATIONS

International Search Report and Written Opinion issued in corresponding IA No. PCT/US2017/027595 dated Jan. 22, 2018.
(Continued)

*Primary Examiner* — Robert F Long

(57) ABSTRACT

An apparatus for reinforcing stapling connections created by an elastic stapling apparatus with a plurality of individual reinforcing elements. The apparatus constructs and deploys the plurality of individual reinforcing elements simultaneously with the elastic stapling apparatus generating a plurality of plastic fasteners. The apparatus manufactures the plurality of individual reinforcing elements from a pair of oppositely disposed rolls of reinforcing stock material. The individual reinforcing elements provide additional structural integrity to articles that are deformable in construction.

14 Claims, 15 Drawing Sheets

(56) References Cited

U.S. PATENT DOCUMENTS 3,650,452 A * 3/1972 Finke ..... B65C 7/005 227/67
3,744,495 A * 7/1973 Johnson ..... A61D 1/08 227/144
3,746,237 A * 7/1973 Nysten ..... A41H 37/005 227/147
3,755,934 A 9/1973 Porcher et al.
3,765,110 A 10/1973 Olsen
3,794,550 A * 2/1974 Taillie ..... B42C 9/0081 156/277
3,830,524 A * 8/1974 Abildgaard ..... B42B 5/00 156/580.1
3,875,648 A * 4/1975 Bone ..... B65C 5/00 29/417
3,940,844 A * 3/1976 Colby ..... B21D 53/46 29/450
3,985,067 A * 10/1976 Livio ..... B65C 7/003 493/6
4,039,078 A 8/1977 Bone
4,111,347 A 9/1978 Bone
4,189,049 A 2/1980 Silver
4,262,406 A * 4/1981 Fredrickson ..... B65B 13/345 24/200
4,271,657 A * 6/1981 Lancaster, III ..... B65B 11/045 53/138.4
4,275,672 A * 6/1981 Clad ..... A01O 5/02 111/99
4,300,326 A * 11/1981 Stackhouse ..... B65B 11/045 53/211
4,369,013 A * 1/1983 Abildgaard ..... B42D 1/02 402/60
4,376,504 A * 3/1983 Birkhofer ..... A41H 37/10 227/32
D273,177 S * 3/1984 Tcherneshoff ..... D8/382
4,525,116 A * 6/1985 Holmberg ..... B42C 9/00 281/2
4,533,076 A 8/1985 Bourque
4,580,815 A * 4/1986 Barber ..... B42F 21/04 156/64
4,589,583 A 5/1986 Kunreuther et al.
4,596,349 A * 6/1986 Herten ..... A41H 37/04 227/119
4,684,050 A * 8/1987 Masas ..... B25C 1/188 227/10
4,718,158 A * 1/1988 Block ..... B65C 7/003 227/152
4,809,568 A * 3/1989 DeCaro ..... B25B 23/10 227/149
5,020,713 A 6/1991 Kunreuther
5,282,829 A * 2/1994 Hermes ..... A61B 17/064 411/479
5,321,872 A 6/1994 Merser
5,373,656 A 12/1994 Merser
5,476,204 A * 12/1995 Eisenpresser ..... A41H 37/00 227/119
5,517,883 A * 5/1996 Goldi ..... B25B 23/12 411/368
5,810,238 A 9/1998 Kunreuther
5,924,620 A 7/1999 Orikasa et al.
5,943,926 A * 8/1999 Habermehl ..... F16B 27/00 206/347
5,975,398 A * 11/1999 Evans ..... B65C 7/005 227/67
5,983,540 A 11/1999 Ashley
6,039,230 A * 3/2000 Yagi ..... B27F 7/38 227/120
6,145,725 A * 11/2000 Omli ..... B25C 5/1693 227/120
6,178,680 B1 * 1/2001 Sloot ..... G09F 3/12 40/661.04
6,536,648 B2 3/2003 Flannery et al.
6,561,406 B1 5/2003 Furutsu et al.
6,598,775 B1 * 7/2003 Chen ..... B25C 7/00 227/113
6,689,039 B2 * 2/2004 Kunreuther ..... B65C 7/003 227/4
6,779,700 B2 * 8/2004 Bruins ..... B25C 1/006 227/120
6,908,022 B2 * 6/2005 Schmitz ..... B25C 5/1693 227/119
6,981,983 B1 * 1/2006 Rosenblatt ..... A61B 17/0401 128/898
7,036,680 B1 5/2006 Flannery
7,344,058 B2 * 3/2008 Bruins ..... B25C 1/003 227/18
7,820,262 B2 10/2010 Dean et al.
8,413,866 B2 4/2013 Cooper et al.
8,657,172 B2 2/2014 Cooper
8,820,601 B2 9/2014 Gilbertson et al.
9,254,131 B2 * 2/2016 Soltz ..... A61B 17/0644
9,650,168 B2 5/2017 Takemoto et al.
2003/0006264 A1 * 1/2003 Flannery ..... B65C 7/003 227/67
2003/0102350 A1 * 6/2003 Liu ..... B25C 5/1693 227/18
2003/0127489 A1 * 7/2003 Flannery ..... B65C 7/00 227/67
2005/0125958 A1 * 6/2005 Deschenes ..... B65C 7/005 24/16 PB
2005/0150928 A1 * 7/2005 Kameyama ..... B25C 1/005 227/120
2006/0289597 A1 * 12/2006 Bruins ..... B25C 5/1693 227/18
2010/0019014 A1 * 1/2010 Rodenhouse ..... B25B 21/002 227/32
2014/0165363 A1 * 6/2014 Cooper ..... G09F 3/14 29/432
2015/0351758 A1 * 12/2015 Shelton, IV ..... A61B 17/00491 606/219
2016/0039555 A1 2/2016 Shilale et al.
2018/0015767 A1 * 1/2018 Kim ..... B25C 5/06

FOREIGN PATENT DOCUMENTS

CN 101563273 10/2009
CN 201334179 10/2009
CN 103946116 7/2014
CN 103999139 8/2014
CN 104080704 10/2014
CN 205891466 U 1/2017
EP 0474938 3/1992
EP 0625317 11/1994
EP 2786364 6/2017
GB 2364092 1/2002
JP 2003-169731 6/2003
JP 3128727 1/2007
TW 201335029 9/2013

OTHER PUBLICATIONS

International Preliminary Report on Patentability issued in corresponding IA No. PCT/US2014/072911 dated Feb. 14, 2017.
Texpac Inc., Automatic Tagging and Fastening Tools, Accessed Feb. 3, 2017 from: https://www.texpak.com/industrial-packaging-and-labeling-equipment/automatic-tagging-and-fastening-tools/.
Avery Dennison Corporation, IndES Elastic Staple System, Accessed Feb. 3, 2017 from: http://pfs.averydennison.com/content/dam/averydennison/rbis/global/en/product-families/Fasteners/docs/IndES-Operator-Manual-rev-4-2014.pdf.
International Search Report and Written Opinion issued in corresponding IA No. PCT/US2014/072911, dated Jul. 20, 2015.
International Preliminary Report on Patentability Opinion issued in corresponding IA No. PCT/US2017/027595 dated Oct. 24, 2019.

* cited by examiner

AUTOMATION FOR PLASTIC DISC

BACKGROUND

The present invention relates generally to an apparatus for manufacturing and deploying reinforcing elements such as plastic discs in conjunction with a fastening system. More particularly, the present disclosure relates to an apparatus for use in combination with an elastic stapling apparatus for reinforcing the stapling connection point on packaging material while securing products to the packaging material with the elastic stapling apparatus.

Elastic or plastic fasteners are commonly used to secure a variety of irregularly shaped products to packaging materials such as cardboard backing. The elastic fasteners are typically H-shaped in configuration, with two shortened parallel crossbars, or T-bars, being interconnected at their approximate midpoints by a thin, flexible filament that extends orthogonally there between. The elastic fasteners, or staples, are typically individually generated from a supply of ladder stock or from separate supplies of filament and T-bar stocks. The elastic fasteners may be formed from ladder stock, such as that presently manufactured and sold by Avery Dennison Corporation of Pasadena, Calif. under PLASTIC STAPLE® and ELASTIC STAPLE™ lines of plastic fasteners.

The elastic fasteners may be generated by a plastic fastener device, such as an IndES® 11601 (IndES) manufactured and sold by Avery Dennison Corporation of Pasadena, Calif. These systems are designed to securely fasten items such as housewares, toys and hardware to backing cards typically manufactured from cardboard. The pneumatically driven IndES unit can operate as a standalone unit or integrated into an automatic packaging line. The plastic fastener devices secure the products to packaging by threading a pair of hollow needles loaded with fastener stock and puncturing the backing card on either side of the product to be secured. An individual elastic fastener is left behind securing the product with a filament to the backing with a pair of T-bars. The pair of T-bars engages the backside of the backing to attach the product to the packaging material.

When each needle penetrates the backing, a hole in the backing material is created. The T-bar portion of the fastener springs perpendicularly to the filament to engage the backing and keep the fastener in place. Heavier products or thin backing material can create a strain on the connection point between the fastener and the backing. This strain can lead to a tear or unwanted expansion of the insertion hole, leading to a loss of the connection. Once a connection is compromised, the product is no longer secured to the packaging.

Thus, there exists a need for a way to reinforce the connection point between the elastic fastener and the backing material. The present invention discloses an apparatus for supplying and deploying reinforcement to this vulnerable connection point. The apparatus generates and installs a plurality of reinforcing elements in conjunction with an elastic stapling device. Elastic fasteners are generated and deployed by the elastic stapling device simultaneously with the generation and deployment of reinforcing elements by the present invention in a single operation.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises an apparatus for manufacturing and positioning a plurality of individual reinforcing elements for use with a plurality of elastic fasteners. The apparatus comprises a base plate and a pair of modules mounted to the base plate. The pair of modules feed a pair of rolls of reinforcing stock through the apparatus and cut off the individual reinforcing elements. The individual reinforcing elements are deployed and positioned by the pair of modules to align with the plurality of elastic fasteners generated and deployed by an elastic stapling apparatus, thereby reinforcing a connection point where the fasteners attach to a backing or packaging material.

In a preferred embodiment, each of the pair of modules comprises a pneumatic element, a linkage drive block, a cutting block, and a cam element. The linkage drive block is engaged by the pneumatic element, and is moveably connected to the cutting block by the cam element. Each of the pair of modules further comprises a strip feed block for feeding one of the pair of rolls of reinforcing stock through the apparatus. Each of the pair of modules further comprises a module cover element for resisting backward movement of one of the pair of rolls of reinforcing stock as it moves through the apparatus, and a cutting element for cutting off the plurality of reinforcing elements once positioned to reinforce the plurality of elastic fasteners.

The pneumatic element is extended, thereby pushing the linkage drive block forward along a guide slot in the cam element. This movement forces the cutting block downward allowing a portion of the reinforcing stock to extend over the cutting block. Once positioned, the pneumatic element is retracted pulling the linkage drive block back forcing the cutting block upward. As the cutting block is pushed upward, the supply of reinforcing stock is forced against the cutting element, thereby severing off an individual reinforcing element.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
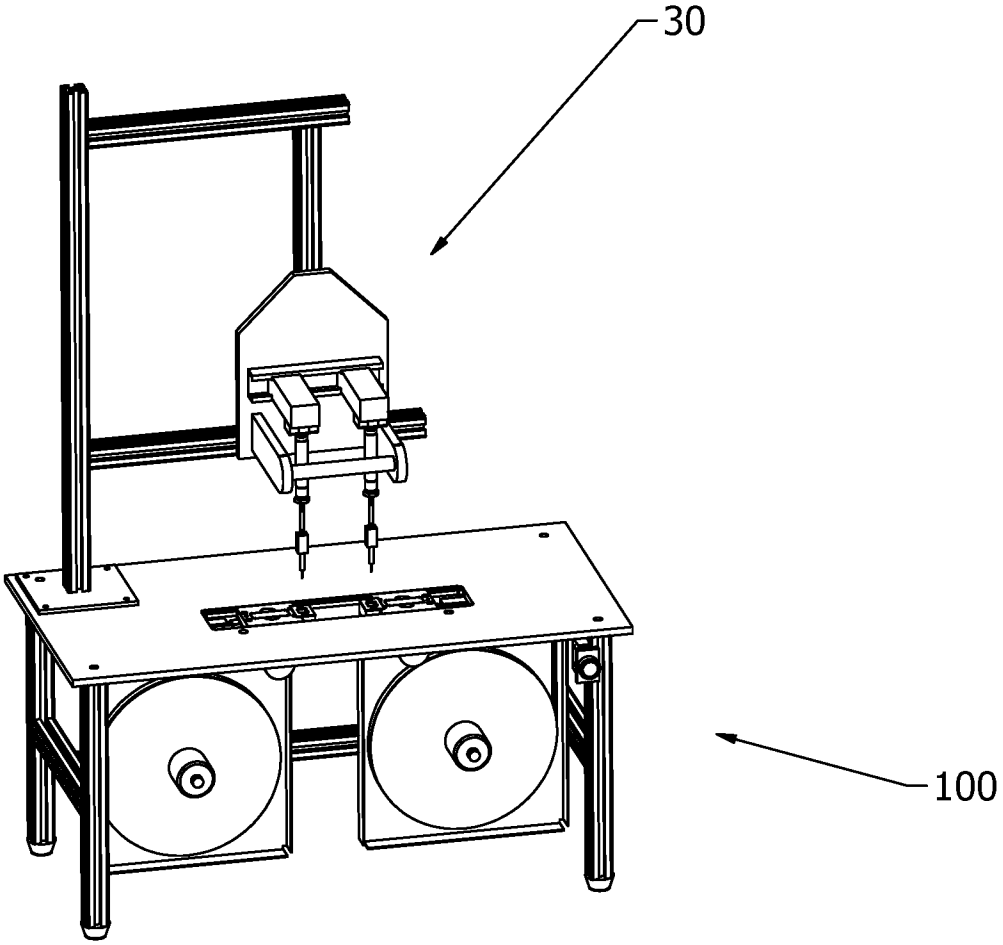
FIG. 1 illustrates a perspective view of an apparatus for dispensing a plurality of individual reinforcing elements from a supply of reinforcing stock for use in conjunction with an elastic stapling apparatus in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

Figure 2:
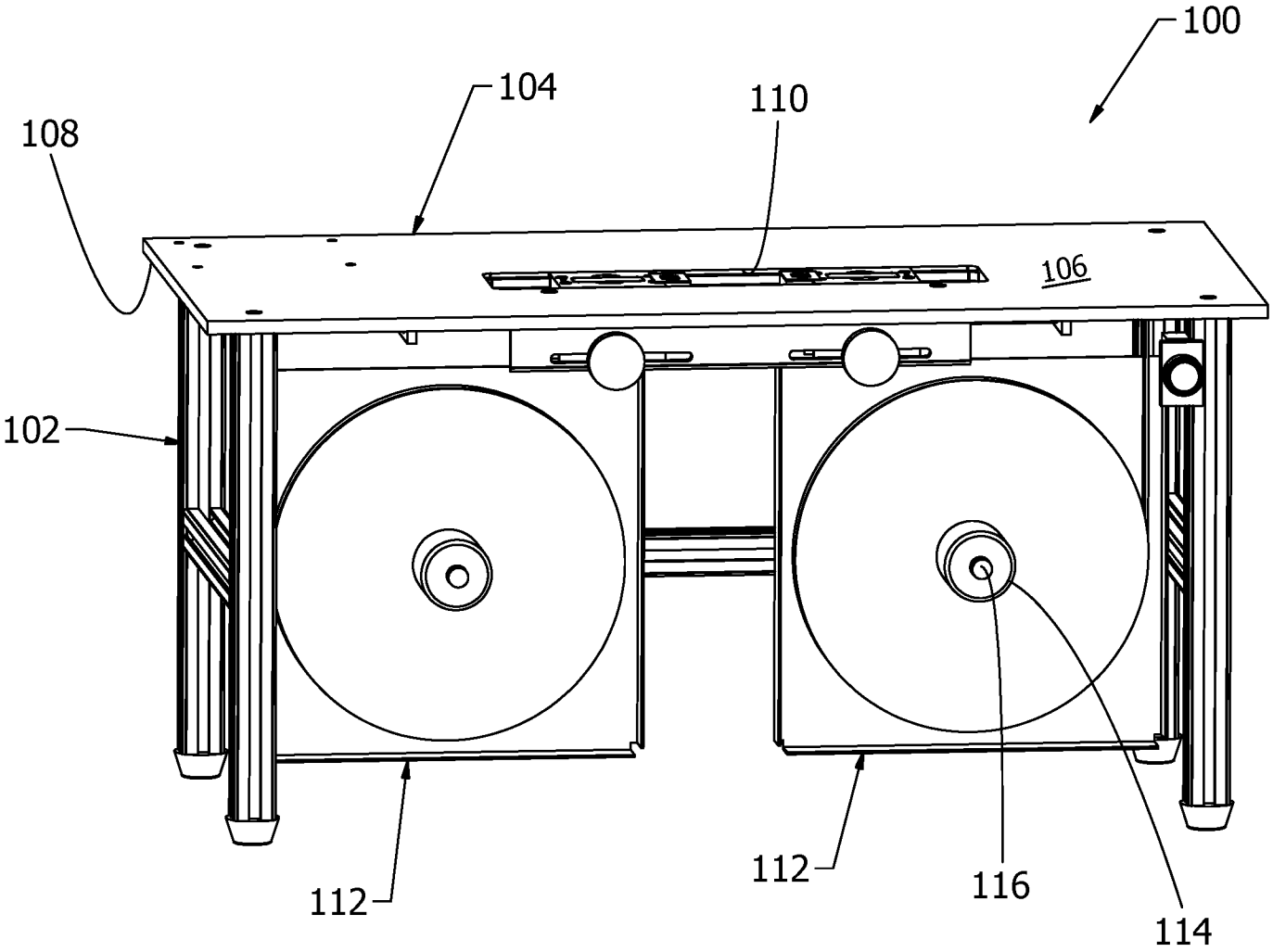
FIG. 2 illustrates a side perspective view of the apparatus in accordance with the disclosed architecture.

Referring initially to the drawings, FIGS. 1-15 illustrate an apparatus 100 for generating a plurality of individual reinforcing elements 60 out of a supply of reinforcing stock 50 in accordance with the present invention. As illustrated in FIGS. 1 and 2, the apparatus 100 comprises a frame 102 and a base plate 104. The base plate 104 comprises a top side 106, a bottom side 108, and is adapted to support an elastic stapling apparatus 30 and the supply of reinforcing stock 50. One example of the elastic stapling apparatus 30 useable with the apparatus 100 is an IndES industrial elastic stapling system, as described supra. The IndES uses a pair of needles approximately 3/16 inches in diameter to fasten products to packaging material, such as cardboard backing, using an elastic staple. The IndES machine's needles puncture the packaging material and eject staple ends through the puncture holes. The staple ends flex into position to fix the elastic staple in place, thereby securing the product to the packaging material.

Figure 3:
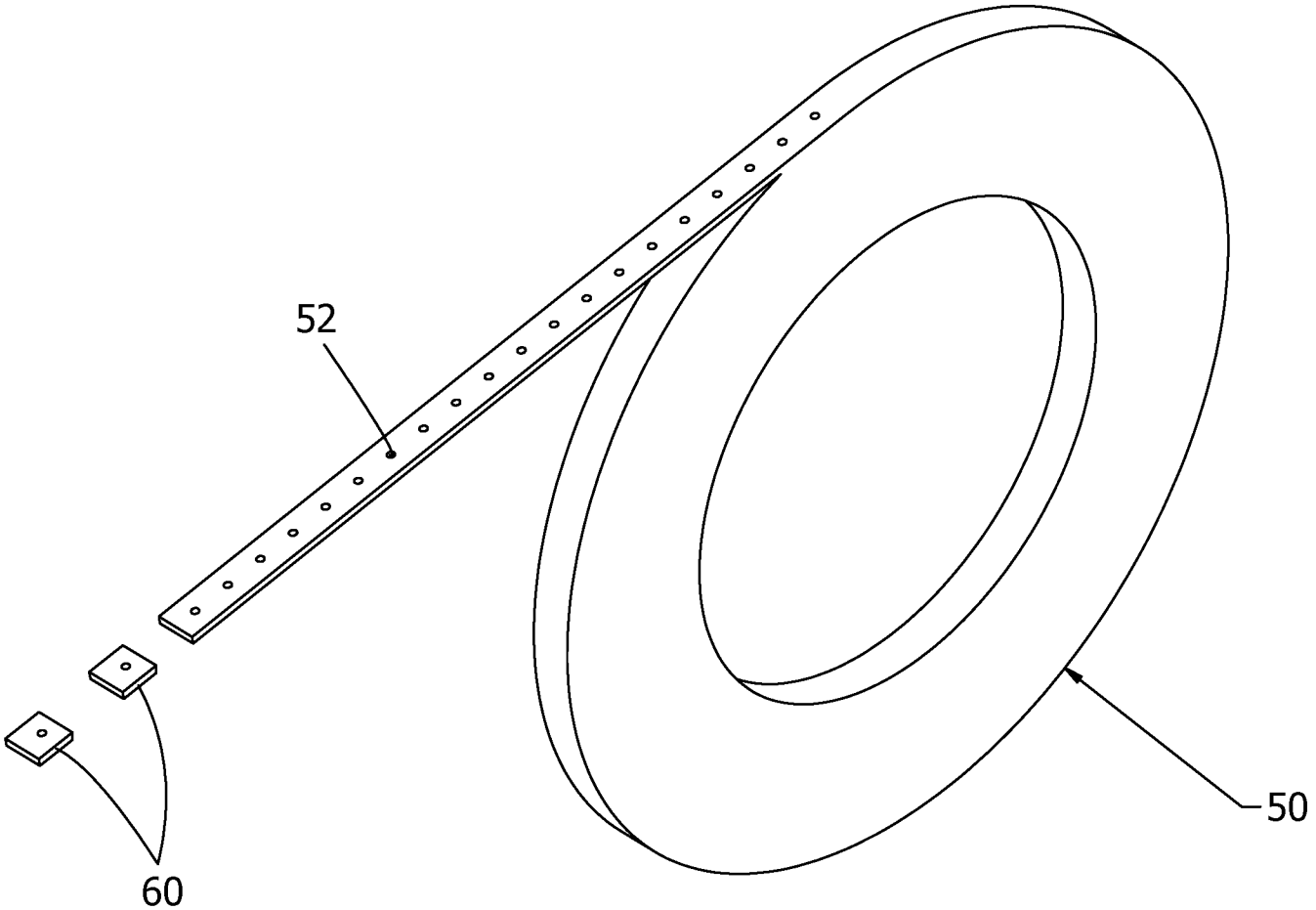
FIG. 3 illustrates a perspective view of a supply of reinforcing stock and a plurality of individual reinforcing elements for use with the apparatus in accordance with the disclosed architecture.

The apparatus 100 may be used to manufacture the plurality of individual reinforcing elements 60 to reinforce a plastic or elastic fastener in a fastener assembly as described in commonly assigned U.S. 2016/0039555A1, which is incorporated herein by reference. As illustrated in FIG. 3, the plurality of individual reinforcing elements 60 are preferably formed as unitary, solid discs, which are constructed out of stiff plastic materials that resist deformation, such as but not limited to, polypropylene, polyethylene, polyethylene terephthalate. The plurality of individual reinforcing elements 60 are represented herein as generally square-shaped tabs. However, this is not meant as a limitation, as the plurality of individual reinforcing elements 60 may be constructed in any alternate configuration, size, or shape as to correspond to the dimensions necessary to reinforce the plastic fastener used.

Figure 4:
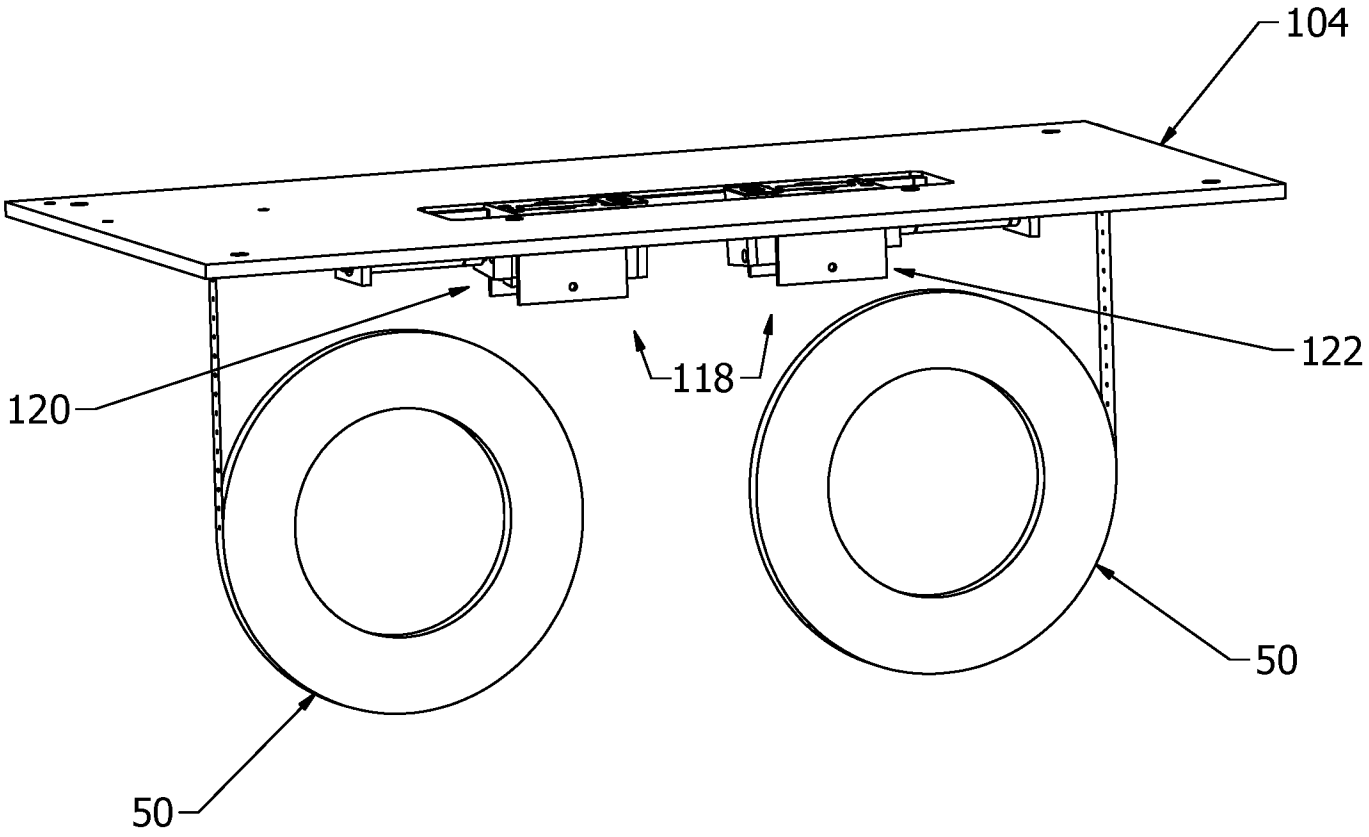
FIG. 4 illustrates a side perspective view of a pair of rolls of the reinforcing stock material fed into a pair of modules attached to a base plate of the apparatus in accordance with the disclosed architecture.
Figure 13:
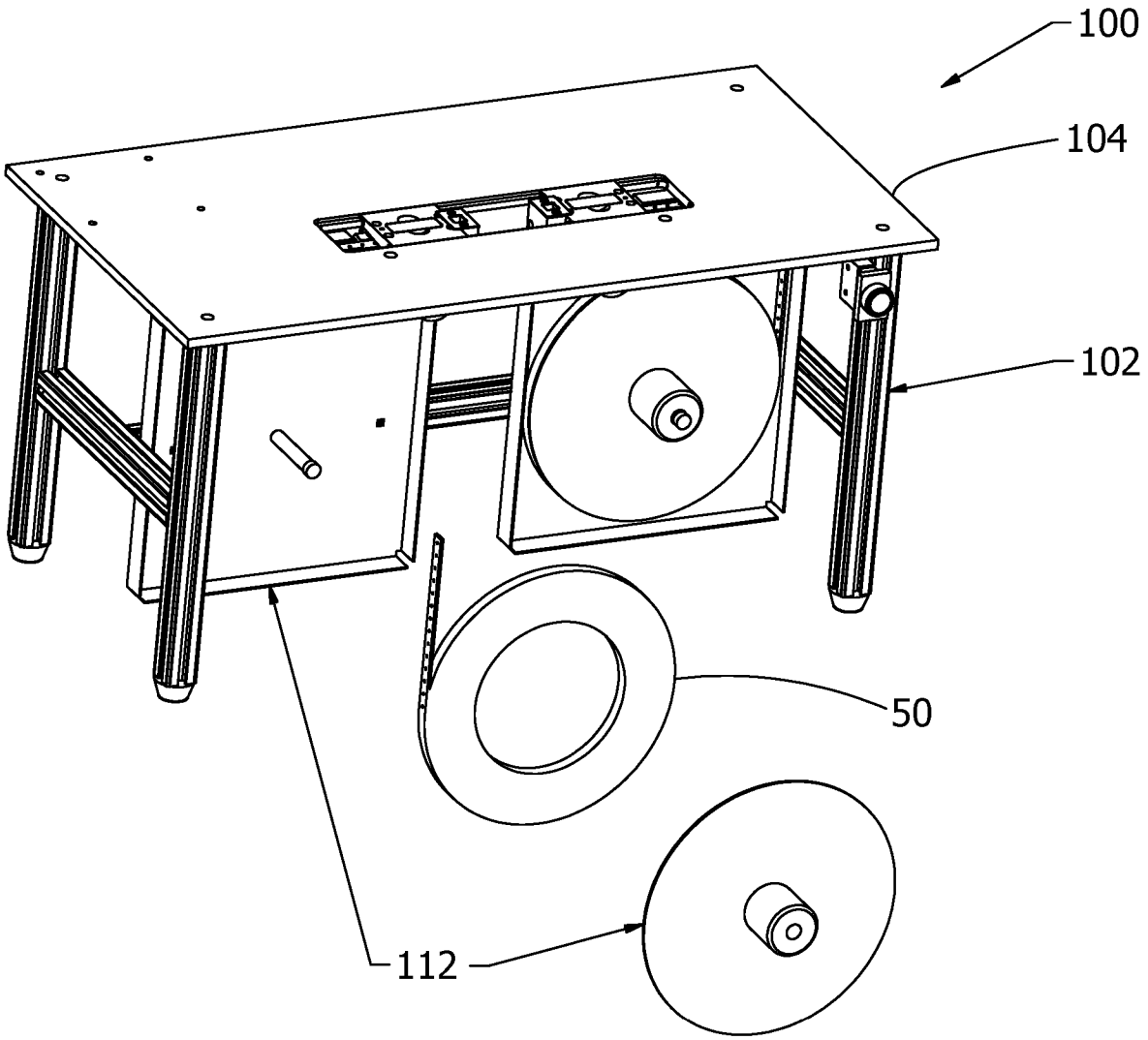
FIG. 13 illustrates a partially exploded view of the supply of reinforcing stock being loaded onto one of a pair of stock engaging components of the apparatus in accordance with the disclosed architecture.

The supply of reinforcing stock 50 for use with the apparatus 100 is typically configured as a pair of rolls of reinforcing stock material. In one embodiment, each of the pair of rolls of reinforcing material is formed from a strip of the stiff plastic material 56 approximately ½ inches in width with a plurality of holes 52 approximately centrally disposed along a centerline at approximately ½ inch intervals. The diameter of each of the plurality of holes 52 is sized slightly larger than the diameter of the needle of the elastic stapling apparatus 30. The pair of rolls of reinforcing stock material are loaded on the apparatus 100, as illustrated in FIGS. 2, 4 and 13, which cuts each strip of the stiff plastic material 56 into approximately ½ inch square individual reinforcing elements 60 with a center hole 52. While specific dimensions have been described with respect to this particular embodiment, the dimensions are not meant as a limitation as the dimensions may be customized for use with any sized plastic fastener as desired.

The apparatus 100 further comprises a pair of stock engaging components 112, each comprising a reel 114 attached to a shaft 116. Each of the pair of stock engaging components 112 are mounted to the frame 102 underneath the base plate 104. The frame 102 serves as a support or foundation for the base 104. The base 104 is generally rectangular in configuration and further comprises a centrally disposed opening 110. Each roll of reinforcing stock material is loaded onto one of the reels 114, which rotates along the shaft 116 feeding each strip of the reinforcing stock material 56 off of the roll of reinforcing stock material into the apparatus 100.

With the plurality of individual reinforcing elements 60 positioned against or near a back side of the packaging, the elastic stapling apparatus 30 punches holes in the packaging material in-line with the plurality of individual reinforcing elements 60, dispenses a plastic fasteners through the needles, and secures each plastic fastener to a reinforced connection point formed by the packaging and one of individual reinforcing elements 60. As such, the plurality of individual reinforcing elements 60 provides structural stability to the packaging material.

Figure 5:
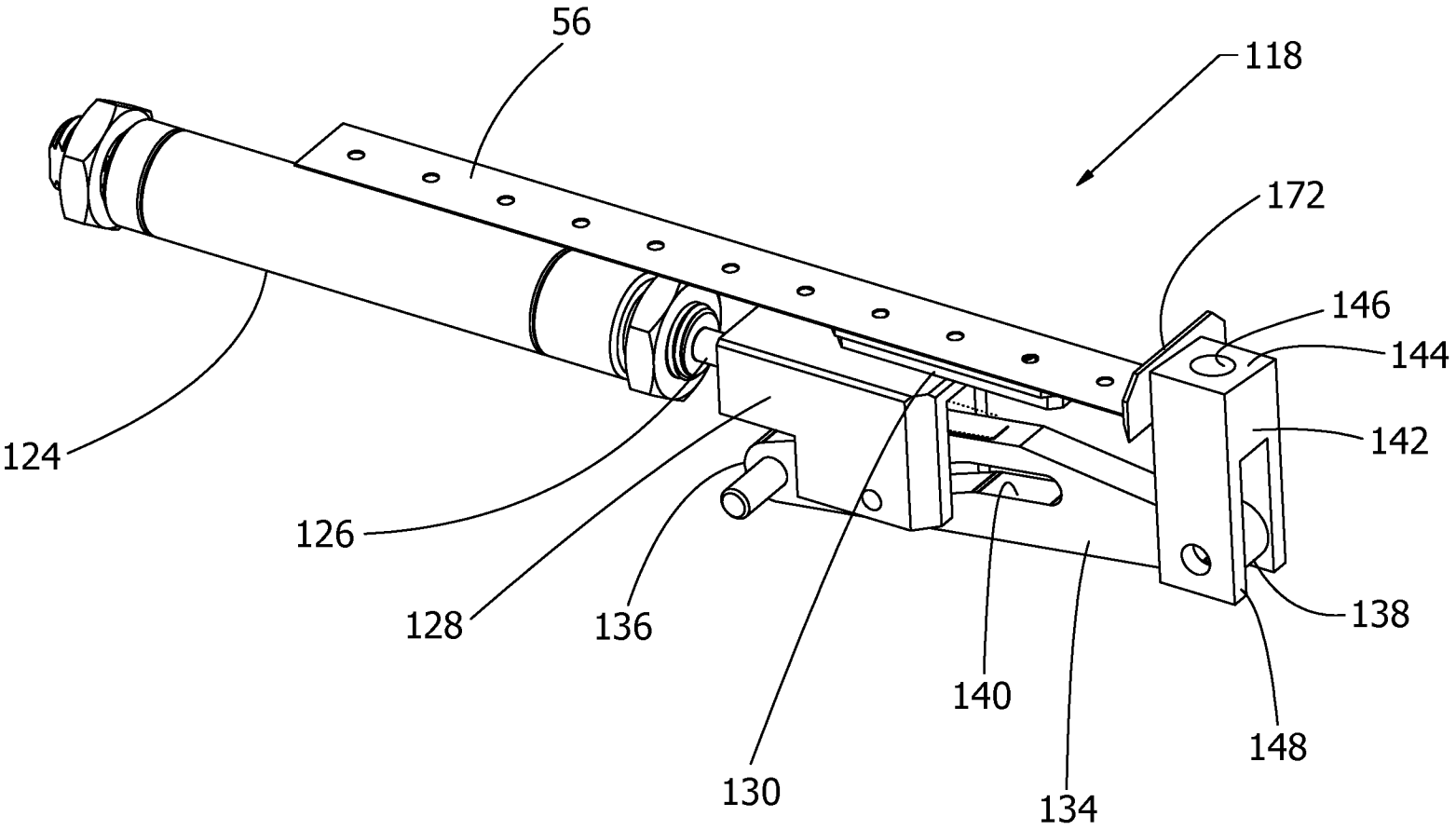
FIG. 5 illustrates a perspective view of one of the pair of modules in accordance with the disclosed architecture.
Figure 10:
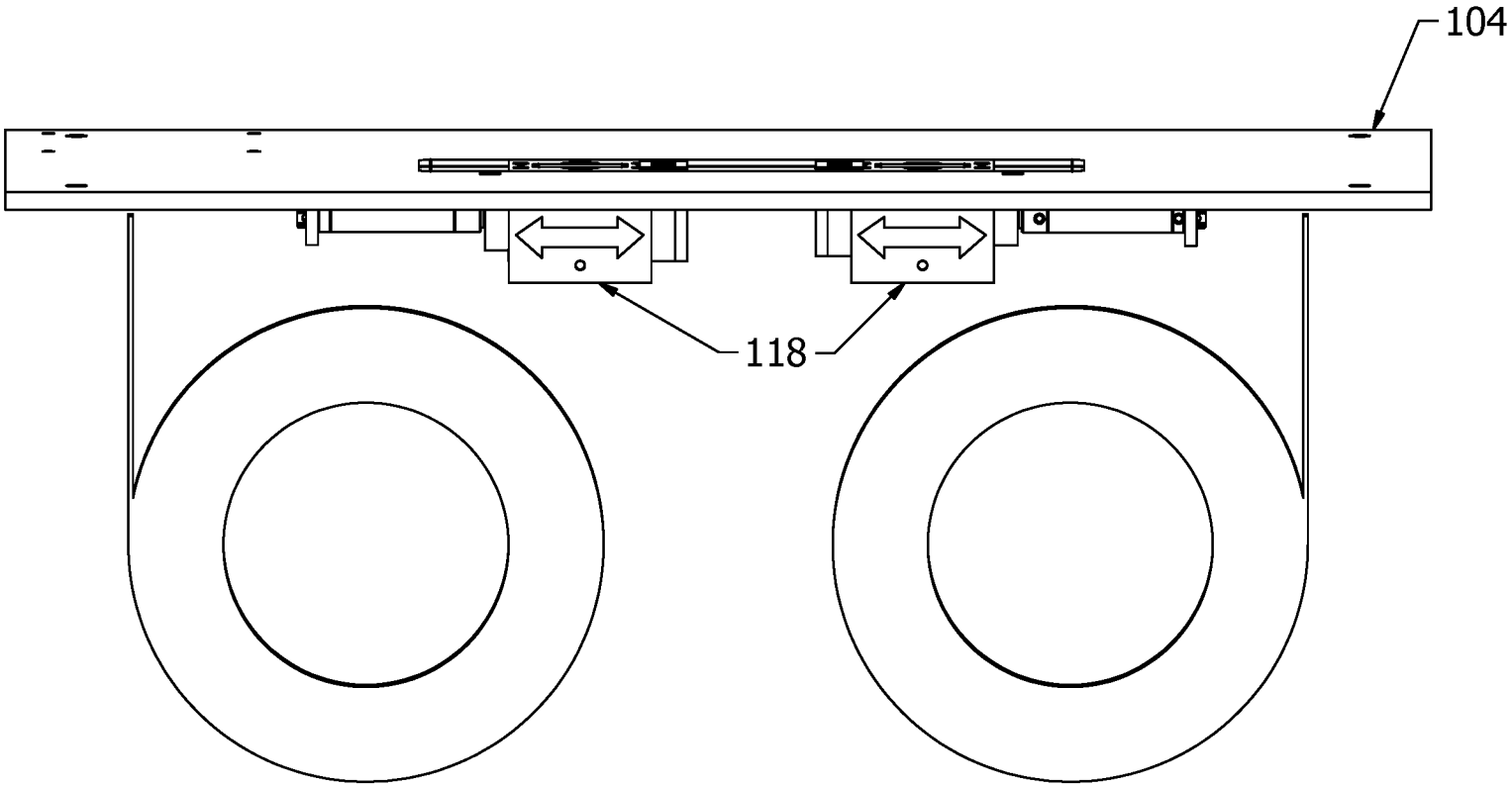
FIG. 10 illustrates a side perspective view of the pair of modules adjustably attached to the base plate in accordance with the disclosed architecture.

As illustrated in FIGS. 4, 5, and 10 the apparatus 100 further comprises a pair of modules 118 movably mounted to the base plate 104 within the centrally disposed opening 110 to align with the elastic stapling apparatus 30. A first 120 and a second 122 of the pair of modules 118 are identically configured, adjustable in position within the centrally disposed opening 110, and movably mounted in opposing directions. The pair of modules 118 are adapted to receive the supply of reinforcing stock 50, sever the supply of reinforcing stock 50 into the plurality of individual reinforcing elements 60, and to deploy the plurality of individual reinforcing elements 60 in conjunction with the elastic staples to reinforce the plurality of stapling connections.

Figure 9:
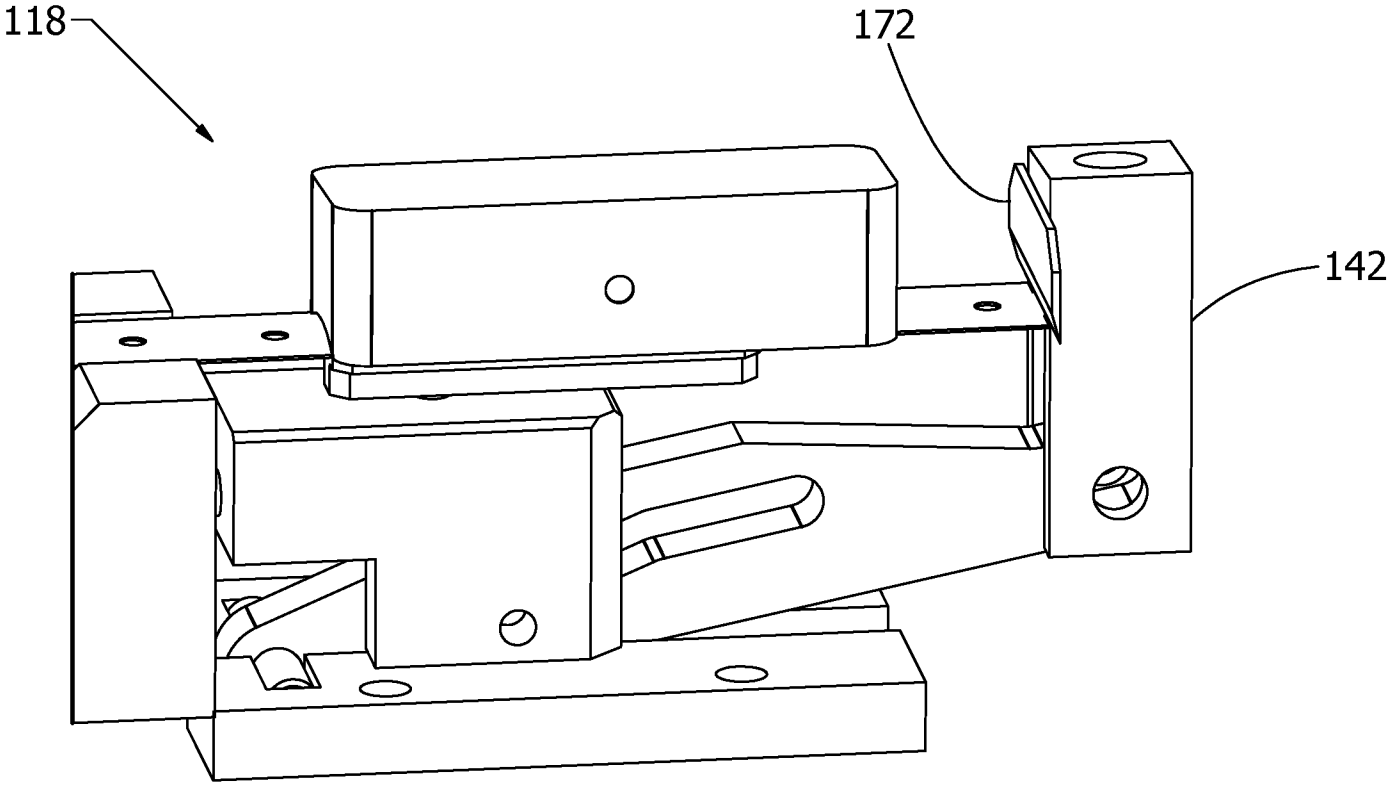
FIG. 9 illustrates a side view a cutting block of one of the pair of modules in a cut position in accordance with the disclosed architecture.

As illustrated in FIGS. 5 and 9, each of the pair of modules 118 comprises a pneumatic element 124, a linkage drive block 128, a cam element 134, and a cutting block 142. The pneumatic element 124 is typically an air cylinder that moves a piston rod 126. The piston rod 126 is connected to one end of the linkage drive block 128. The cam element 134 comprises a first end 136 fixed to the module 118, a second end 138 movably connected to the cutting block 142, and a guide slot 140. The other end of the linkage drive block 128 is movably retained within the guide slot 140 of the cam element 136. As such, the cam element 142 movably connects the linkage drive block 128 and the cutting block 142. The guide slot 140 is generally angularly configured so as to move the cutting block 142 up and down as the piston rod 126 is pushed or retracted by the pneumatic element 124.

Figure 6A:
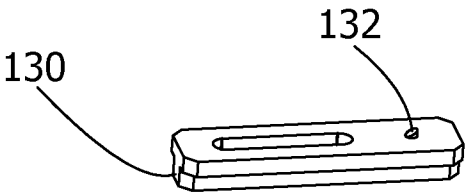
FIG. 6A illustrates a side perspective view of a stock positioning element of the strip feed block in accordance with the disclosed architecture.
Figure 6:
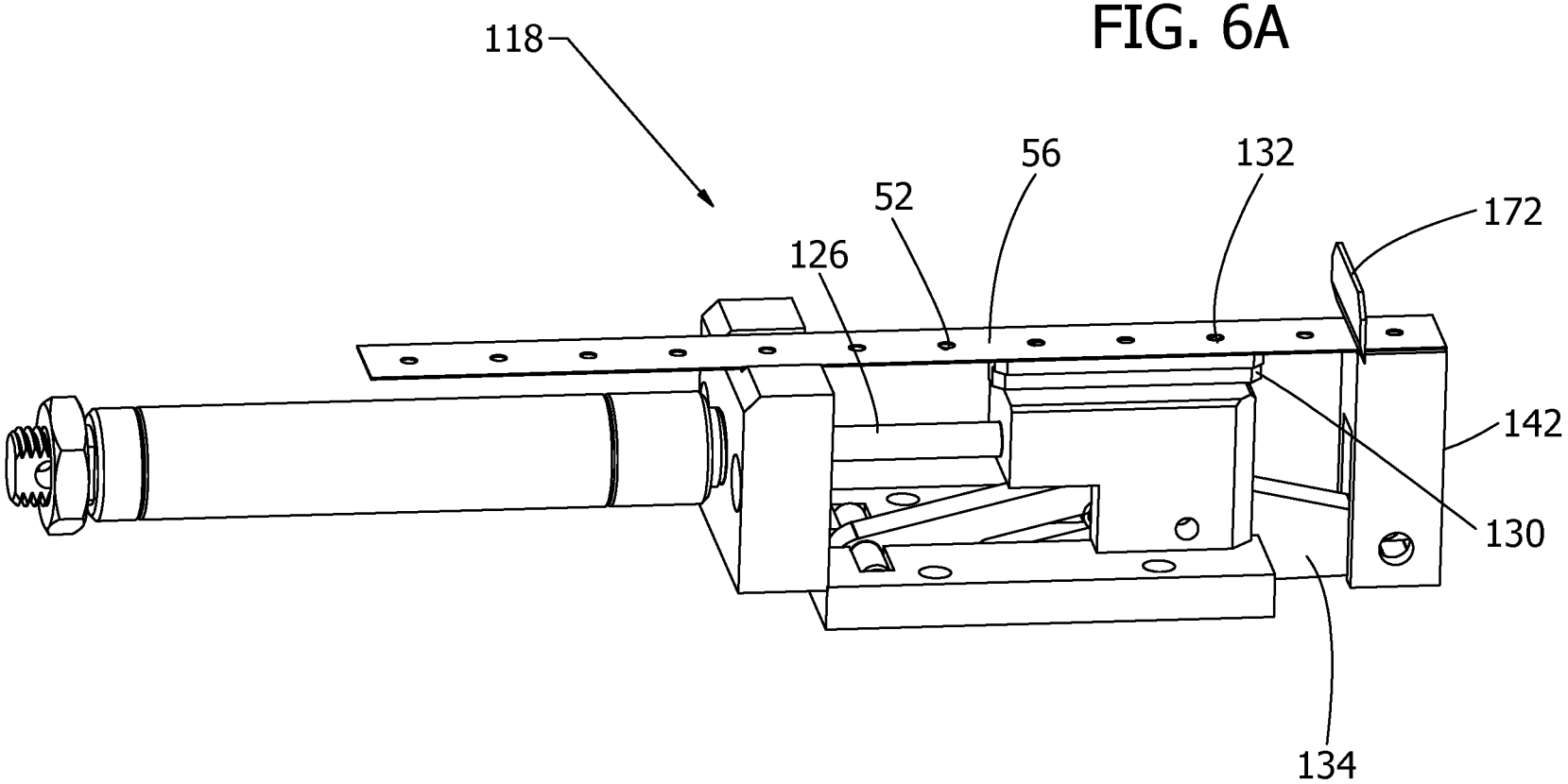
FIG. 6 illustrates a side perspective view of a strip feed block of one of the pair of modules in accordance with the disclosed architecture.

As illustrated in FIGS. 6 and 6A, each module 118 further comprises a strip feed block 130 comprising a stock positioning element 132. The strip feed block 130 is mounted to a top of the linkage drive block 128. The stock positioning element 132 is typically a pin beveled so as to engage the plurality of holes 52 in a portion of the supply of reinforcing stock 50 running along the strip feed block 130. The stock positioning element 132 advances the supply of reinforcing stock 50 through the module 118 as the linkage drive block 128 is pushed forward by the piston rod 126.

Figure 8:
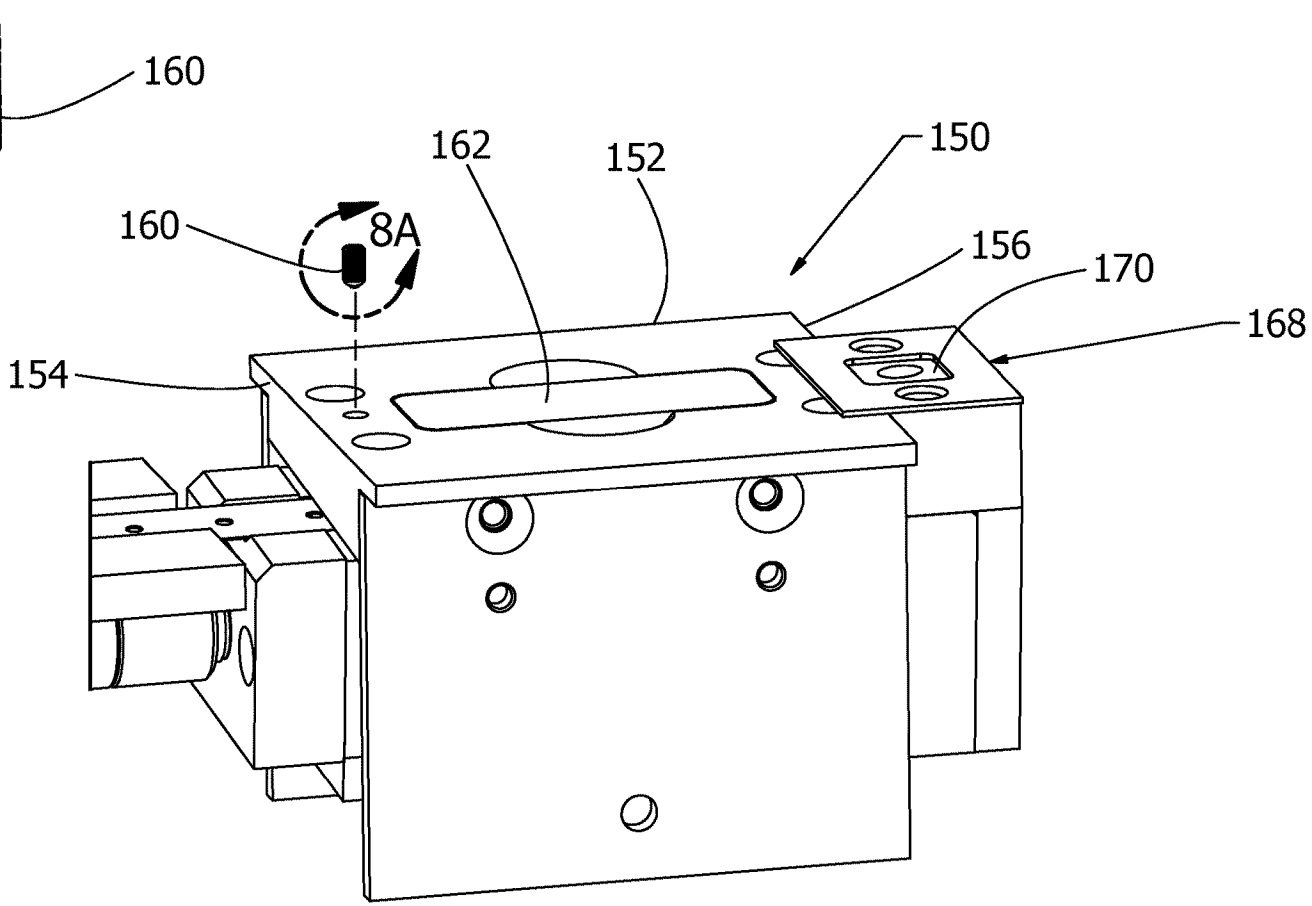
FIG. 8 illustrates a side view of a module cover element of one of the pair of modules in accordance with the disclosed architecture.
Figure 8A:
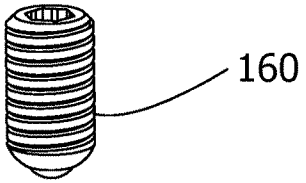
FIG. 8A illustrates a side view of a detent component of the module cover element in accordance with the disclosed architecture.
Figure 11:
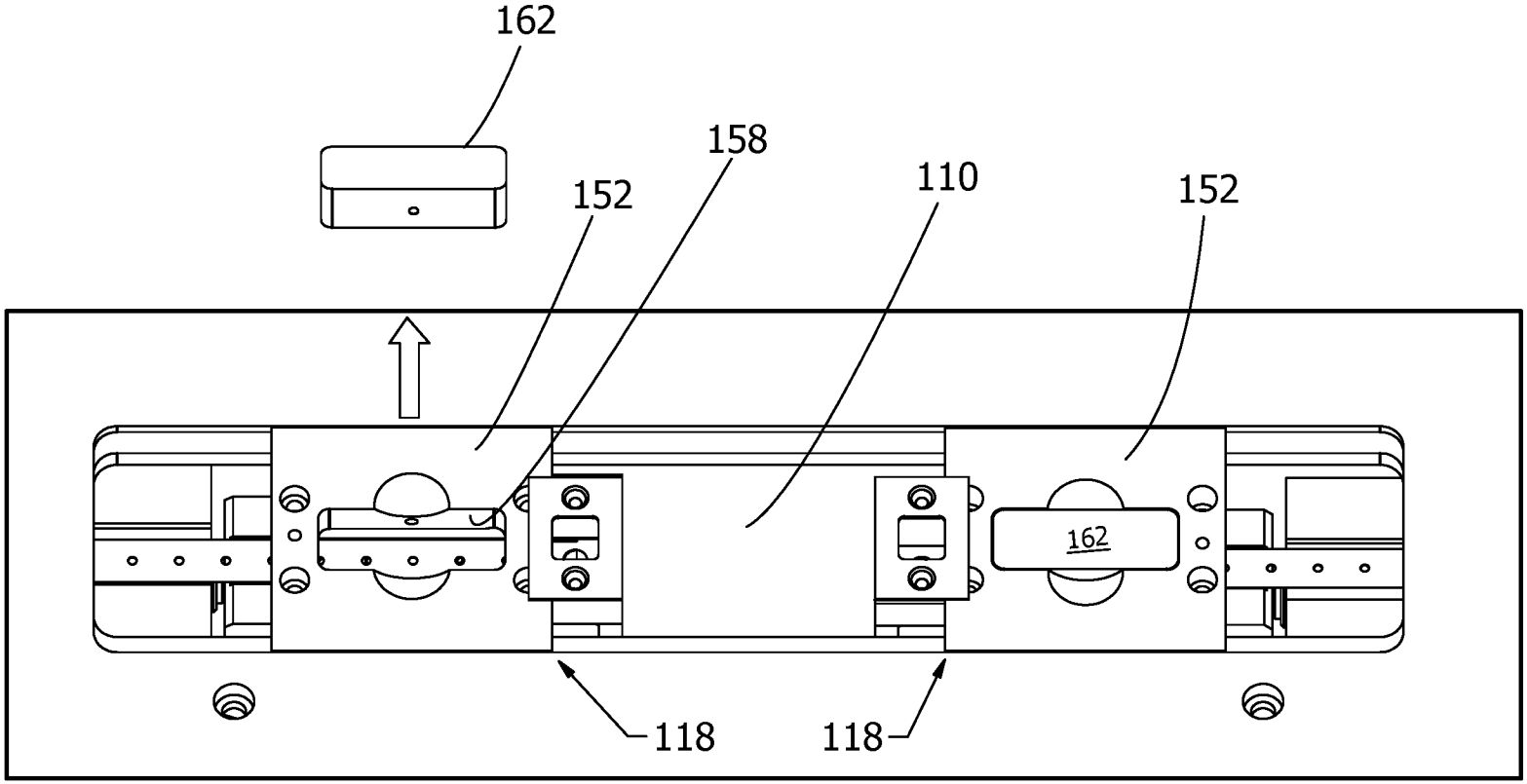
FIG. 11 illustrates an overhead view of a center slot in a top plate of the module cover element in accordance with the disclosed architecture.

As illustrated in FIGS. 8, 8A, and 11 each module 118 further comprises a module cover element 150 comprising a top plate 152 and a detent component 160. The module cover element 150 is positioned within the centrally disposed opening 110 of the base plate 104. The top plate 152 comprises a first end 154, a second end 156, and a center slot 158. The second end 156 of the first module 120 is positioned to face the second end 156 of the second module 122 within the centrally disposed opening 110 of the base plate 104. The detent component 160 is typically a ball, cylinder, or similar mechanism that penetrates the top plate 152 near the first end 154 that can align and engage with the plurality of holes 52 in the supply of reinforcing stock 50 to resist or arrest any backward movement of the supply of reinforcing stock 50 as it is advanced through the module 118 by the stock positioning element 132.

Figure 7:
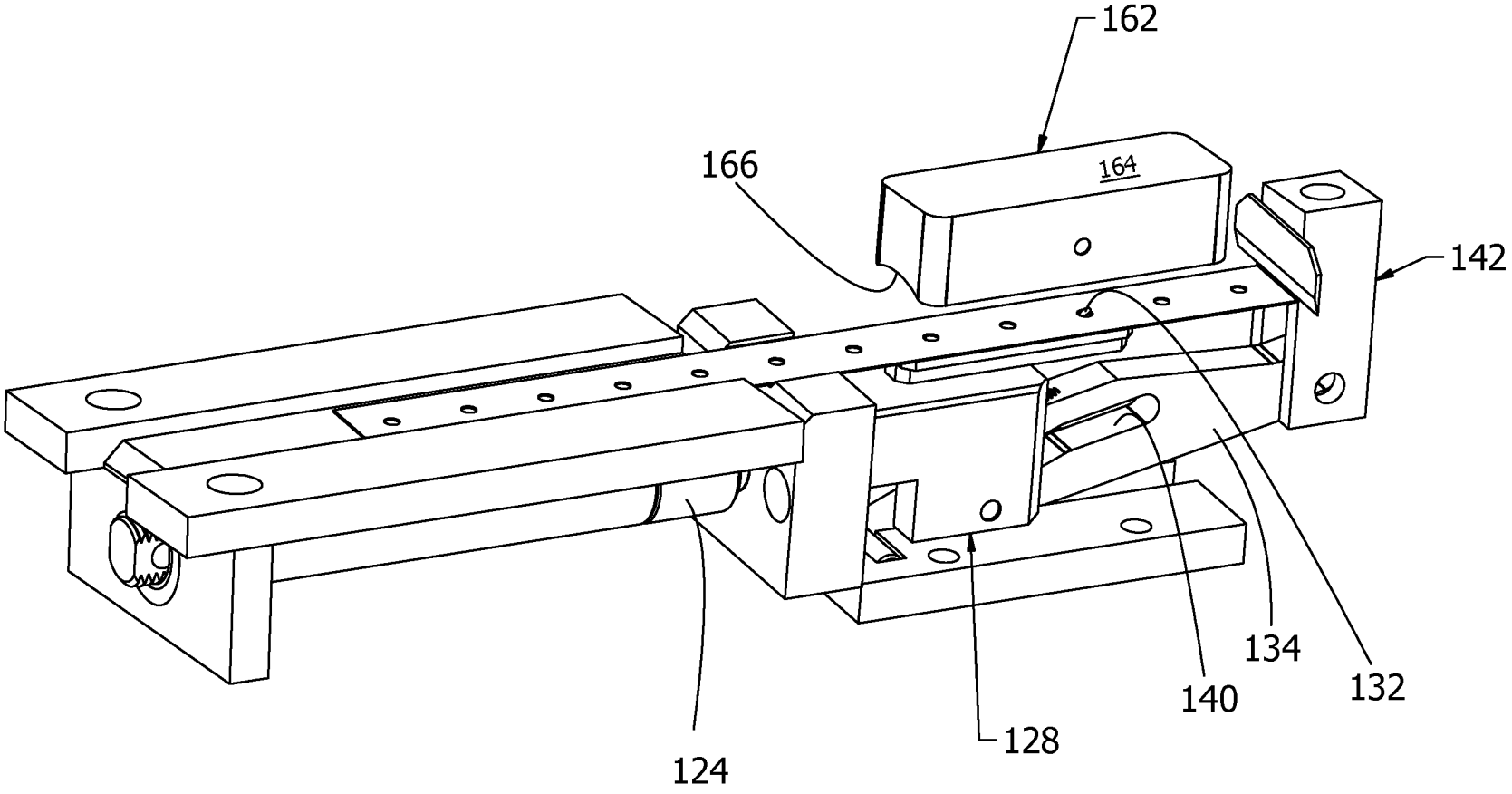
FIG. 7 illustrates a perspective view of a top cover block of one of the pair of modules in accordance with the disclosed architecture.

Additionally, each module 118 further comprises a top cover block 162 as illustrated in FIG. 7. The top cover block 162 is positioned within the center slot 158 of the top plate 152. The top cover block 162 is substantially rectangular in configuration comprising a top side 164 and a bottom side 166 crowned or otherwise concavely shaped to permit the stock positioning element 132 to advance the supply of reinforcing stock 50 through the module 118. As such, the bottom side 166 of the top cover block 162 generally abuts the strip feed block 130 sandwiching or otherwise substantially encapsulation the portion of the supply of reinforcing stock 50 engaged by the module 118.

Each module 118 further comprises a top retaining plate 168 and a cutting element 172. The top retaining plate 168 is attached to the second end 156 of the top plate 152 and comprises an opening 170 generally shaped in the same configuration as each of the individual reinforcing elements 60. The cutting block 142 comprises a beveled top 144, a center hole 146, and a bottom 148. The beveled top 144 of the cutting block 142 penetrates the opening 170, thereby pushing the individual reinforcing elements 60 through the opening 170 once cut. The cutting element 172 is typically a stationary knife or blade attached to the second end 156 of the module cover element 150 where it movably abuts the cutting block 142.

Figure 12:
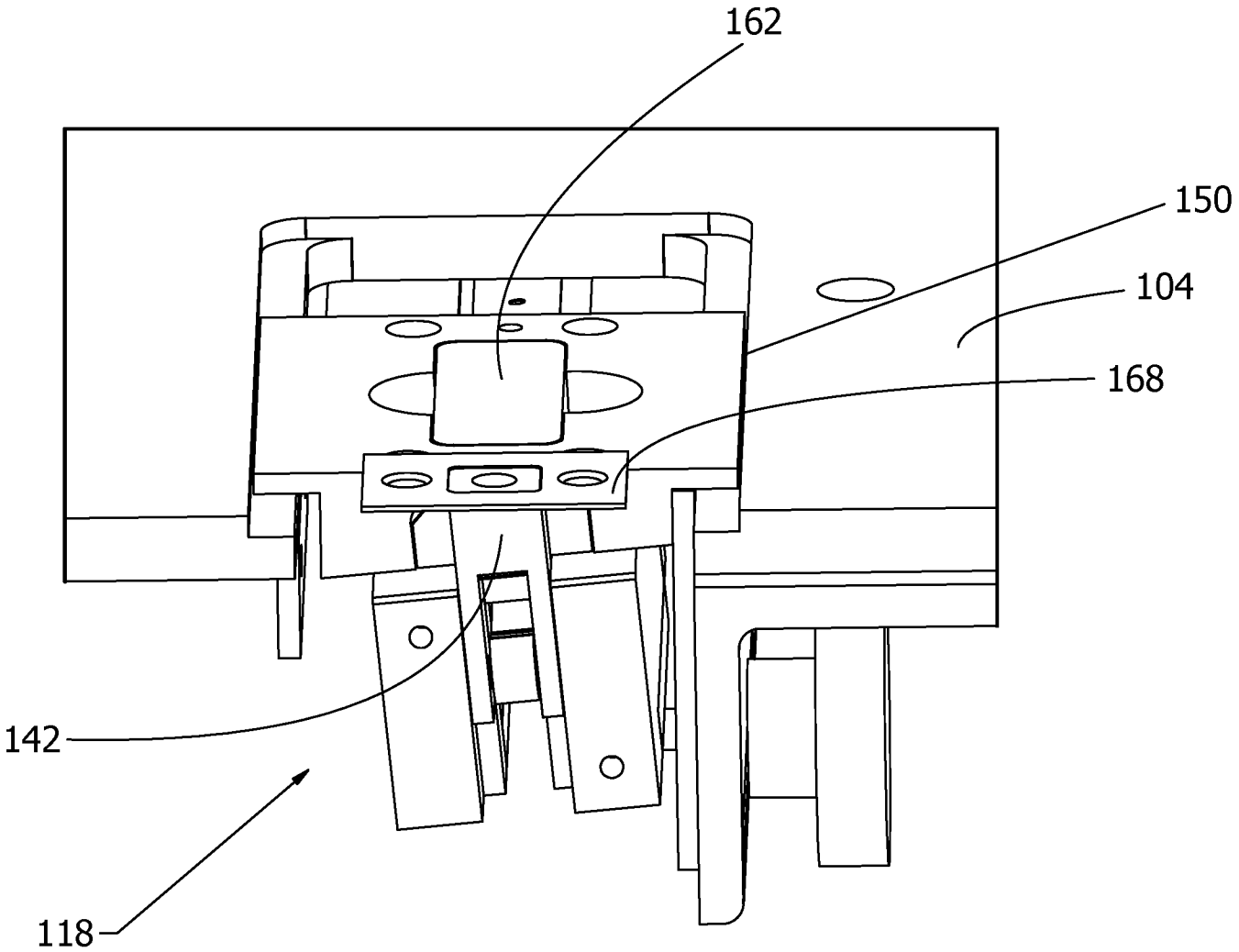
FIG. 12 illustrates an end cut away view of one of the pair of modules in accordance with the disclosed architecture.

As illustrated in FIG. 12, the beveled top 144 may be angled sideways with respect to the cutting element 172 to more easily cut the individual reinforcing elements 60. In a preferred embodiment, the bevel is approximately set at 5 degrees. However, this is not meant as a limitation as the bevel may be changed to optimize cutting based on the material to be cut or the speed of cutting. The center hole 146 is dimensioned and configured to accept penetration of a needle from the elastic stapling apparatus 30. The bottom 148 movably engages the cam element 134.

Figure 14:
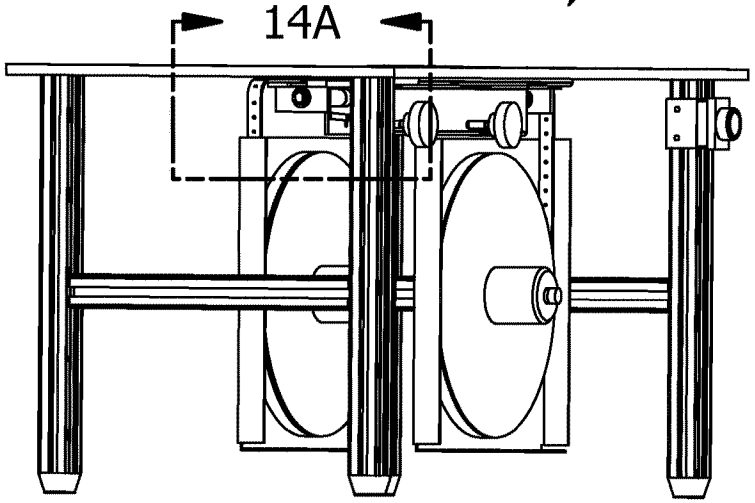
FIG. 14 illustrates a side perspective view of a strip of the reinforcing stock material being fed into one of the pair of modules in accordance with the disclosed architecture.
Figure 14A:
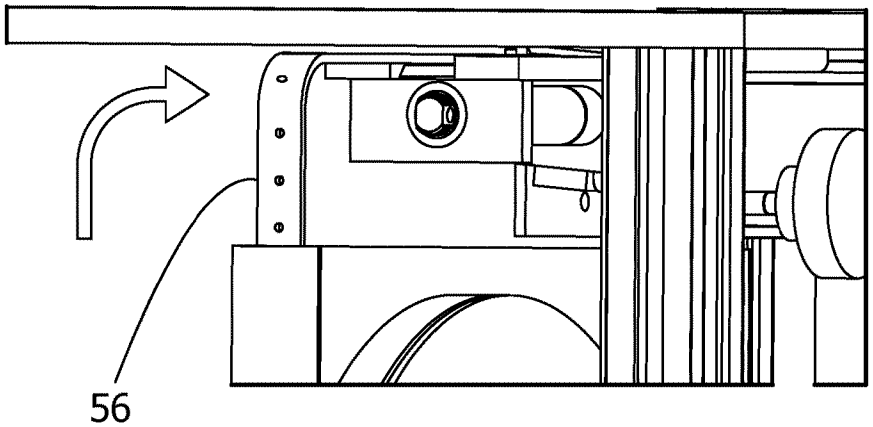
FIG. 14A illustrates a cut away view of the strip of the reinforcing stock material being fed into one of the pair of modules in accordance with the disclosed architecture

To use the apparatus 100, a user places each of the pair of rolls of the reinforcing stock material 50 onto one of the pair of stock engaging components 112, as illustrated in FIGS. 14 and 14A. A strip the reinforcing stock material 56 from each roll is individually fed into one of pair of modules 118 in opposing directions. Each strip feed block 130 engages one of the strips the reinforcing stock material 56 with the stock positioning element 132. The apparatus 100 may be powered with a motor (not shown).

Figure 15A:
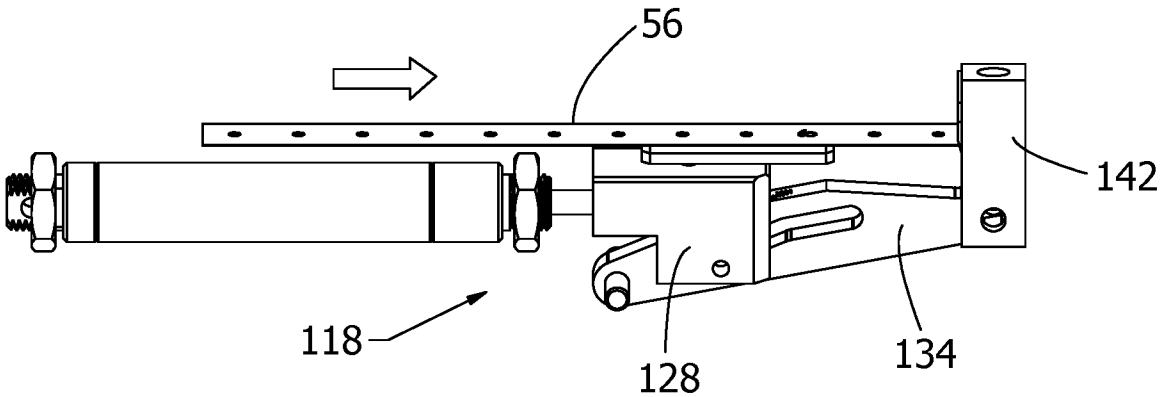
FIG. 15A illustrates a perspective view of one of the plurality of modules in a load position in accordance with the disclosed architecture.
Figure 15B:
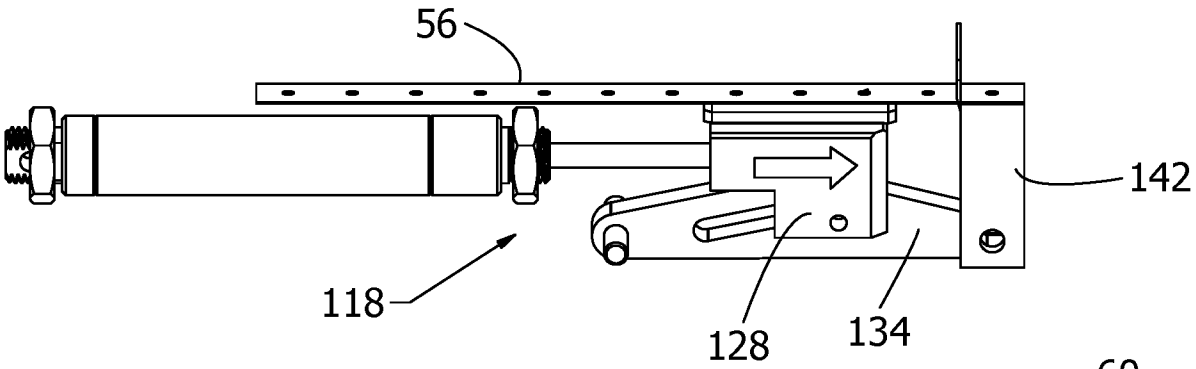
FIG. 15B illustrates a perspective view of one of the plurality of modules in a feed position in accordance with the disclosed architecture.

As illustrated in FIG. 15 A, the strip of the reinforcing stock material 56 is positioned on the strip feed block 130 so that an end of the strip the reinforcing stock material 56 abuts the cutting block 142. In a load position, the piston rod 126 is fully retracted holding the linkage drive block 128 away from the cutting block 142. As the apparatus 100 is engaged, the piston rod 126 is extended by the pneumatic element 124 pushing the linkage drive block 128 along the guide slot 140 of the cam element 134 toward the cutting block 142, as illustrated in FIG. 15B. As the linkage drive block 128 moves forward, the cam element 134 pulls the cutting block 142 downward so that the beveled top 144 drops below the level of the cutting element 172. At the same time, the linkage drive block 128 advances the strip feed block 130 so that approximately a ½ inch portion of the supply of reinforcing stock, or any configured length of the plurality of individual reinforcing elements 60 as desired, is pushed past the cutting element 172 and over the cutting block 142.

Figure 15C:
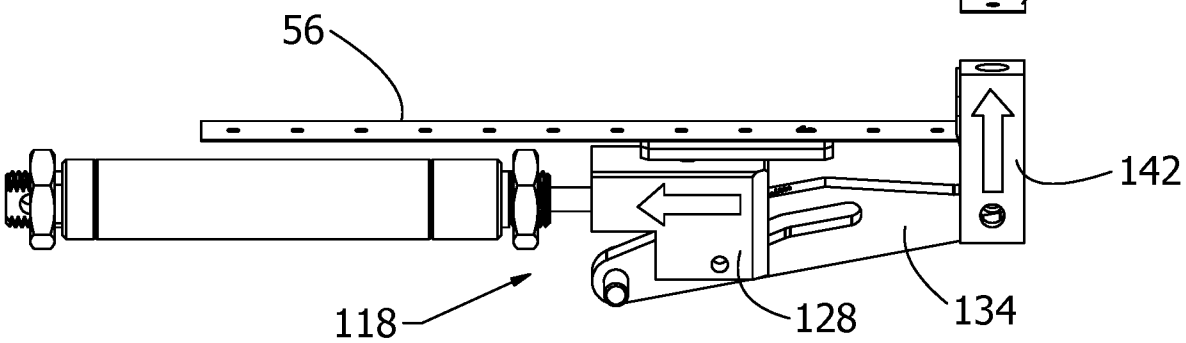
FIG. 15C illustrates a perspective view of one of the plurality of modules in a cut position in accordance with the disclosed architecture.

Finally, in a cutting position illustrated in FIG. 15C, the piston rod 126 is retracted by the pneumatic element 124 pulling the linkage drive block 128 back along the guide slot 140 of the cam element 134 away from the cutting block 142. This retraction allows the cam element 134 to push the cutting block 142 upward against the portion of supply of reinforcing stock located over the beveled top 144. The upward movement forces the beveled top 144 against the supply of reinforcing stock pushing it along the cutting element 172 and through the opening 170 in the top retaining plate 168 to form and detach an individual reinforcing element 60. Simultaneously, the strip feed block 130 returns to its original position as the stock positioning element 132 slips out of the engaged hole 52, and re-engages a distal hole 52 in the supply of reinforcing stock 50 so that the process may repeat. The apparatus 100 may be automatically adjustable to align the plurality of holes 52 of the individual reinforcing elements 60 with the needles of the elastic stapling apparatus 30. As the elastic stapling apparatus 30 is cycled, the apparatus 100 may index the strips of reinforcing material 56 through the next application.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparatus for manufacturing a plurality of individual reinforcing elements from a supply of reinforcing stock, comprising:

a base plate adapted to support the supply of reinforcing stock;

a pair of modules mounted to the base plate adapted to receive the supply of reinforcing stock, sever the reinforcing stock to form individual reinforcing elements, and deploy the individual reinforcing elements, each module having a strip feed block, a linkage drive block, a cutting block, and a pneumatic element; wherein the strip feed block is mounted to a top of the linkage drive block and the linkage drive block is engaged by the pneumatic element, and is moveability connected to the cutting block by a cam element;

the strip feed block being positioned to advance the reinforcing stock through the module when the strip feed block is driven by the linkage drive block;

the linkage drive block being engaged by the pneumatic element; and the cutting block configured to be driven by the linkage drive block to sever the reinforcing stock to form individual reinforcing element;

wherein the base plate comprises a centrally disposed opening; and wherein the pair of modules are adjustable in position along the centrally disposed opening.

2. The apparatus of claim 1, wherein the strip feed block comprises a stock positioning element for engaging and advancing the supply of reinforcing stock through the module.

3. The apparatus of claim 2, wherein each module further comprises a top cover block abutting the strip feed block to substantially encapsulate a portion of the supply of reinforcing stock engaged by the module.

4. The apparatus of claim 1, wherein each module further comprises a module cover element located within the centrally disposed opening of the base plate.

5. The apparatus of claim 4, wherein the module cover element comprises a detent component for engaging and resisting backward movement of the supply of reinforcing stock through the module.

6. The apparatus of claim 5, wherein each module further comprises a cutting element abutting the cutting block.

7. The apparatus of claim 6, wherein the supply of reinforcing stock is advanced through each module and over the cutting block when the pneumatic element is extended pushing the linkage drive block forward along a guide slot in the cam element, thereby moving the cutting block downward.

8. The apparatus of claim 7, wherein the pneumatic element is retracted pulling the linkage drive block backward along the guide slot in the cam element, thereby moving the cutting block upward.

9. The apparatus of claim 8, wherein the upward movement of the cutting block pushes the supply of reinforcing stock against the cutting element detaching an individual reinforcing element.

10. The apparatus of claim 1, wherein the base plate is adapted to support an elastic stapling apparatus to be used in conjunction with the individual reinforcing elements, and wherein the supply of reinforcing stock comprises a pair of rolls of reinforcing stock material.

11. The apparatus of claim 1, wherein the cutting block comprises a beveled top and a hole for accepting a needle of the elastic stapling apparatus.

12. The apparatus of claim 1, wherein the pair of modules are oppositely aligned along a centrally disposed opening in the base plate.

13. The apparatus of claim 1, wherein each of the pair of rolls of reinforcing stock material are individually fed into one of the pair of modules in opposing directions.

14. The apparatus of claim 1, wherein each module further comprises:

a cam element movably connecting the linkage drive block and the cutting block.

* * * * *